United States Patent [19]

Schmitz

[11] 4,386,683

[45] Jun. 7, 1983

[54] BRAKE FOR A WEAVING MACHINE

[75] Inventor: Gerd Schmitz, Sulz-Attikon, Switzerland

[73] Assignee: Sulzer Brothers Limited, Winterthur, Switzerland

[21] Appl. No.: 254,091

[22] Filed: Apr. 14, 1981

Related U.S. Application Data

[63] Continuation of Ser. No. 45,939, Jun. 6, 1979, abandoned.

[30] Foreign Application Priority Data

Jun. 13, 1978 [CH] Switzerland ..... 6421/78

[51] Int. Cl.[3] ..... F16D 49/04

[52] U.S. Cl. ..... 188/77 R; 139/111; 188/166; 242/156.2

[58] Field of Search ..... 188/77 R, 166, 171, 188/173; 242/75.4, 75.41, 156.2; 139/111

[56] References Cited

U.S. PATENT DOCUMENTS 1,646,539 10/1927 Johnson ..... 188/77 R
2,026,715 1/1936 Tyler et al. ..... 188/77 R
3,830,344 8/1974 Cervenee et al. ..... 188/171
4,132,292 1/1979 Dufresne ..... 188/171

FOREIGN PATENT DOCUMENTS 1019683 11/1957 Fed. Rep. of Germany ..... 188/171
381176 10/1954 Switzerland .

*Primary Examiner*—George E. A. Halvosa
*Attorney, Agent, or Firm*—Kenyon & Kenyon

[57] ABSTRACT

The brake uses a slow brake feature whereby a positioning member, such as a lever, is actuated directly via a first spring to cause braking in response to faults only on the weaving side as well as a fast or normal brake feature whereby the positioning member is able to transmit the braking force of a second spring to effect braking in response to faults on the weaving side or mechanical side. The second spring acts on the positioning member via an abutment which is moved against the positioning member upon release of the second spring. The second spring can be released via an electromagnet in response to a weaving fault on the weaving side or by a stop-motion rod in response to a mechanical fault.

2 Claims, 1 Drawing Figure

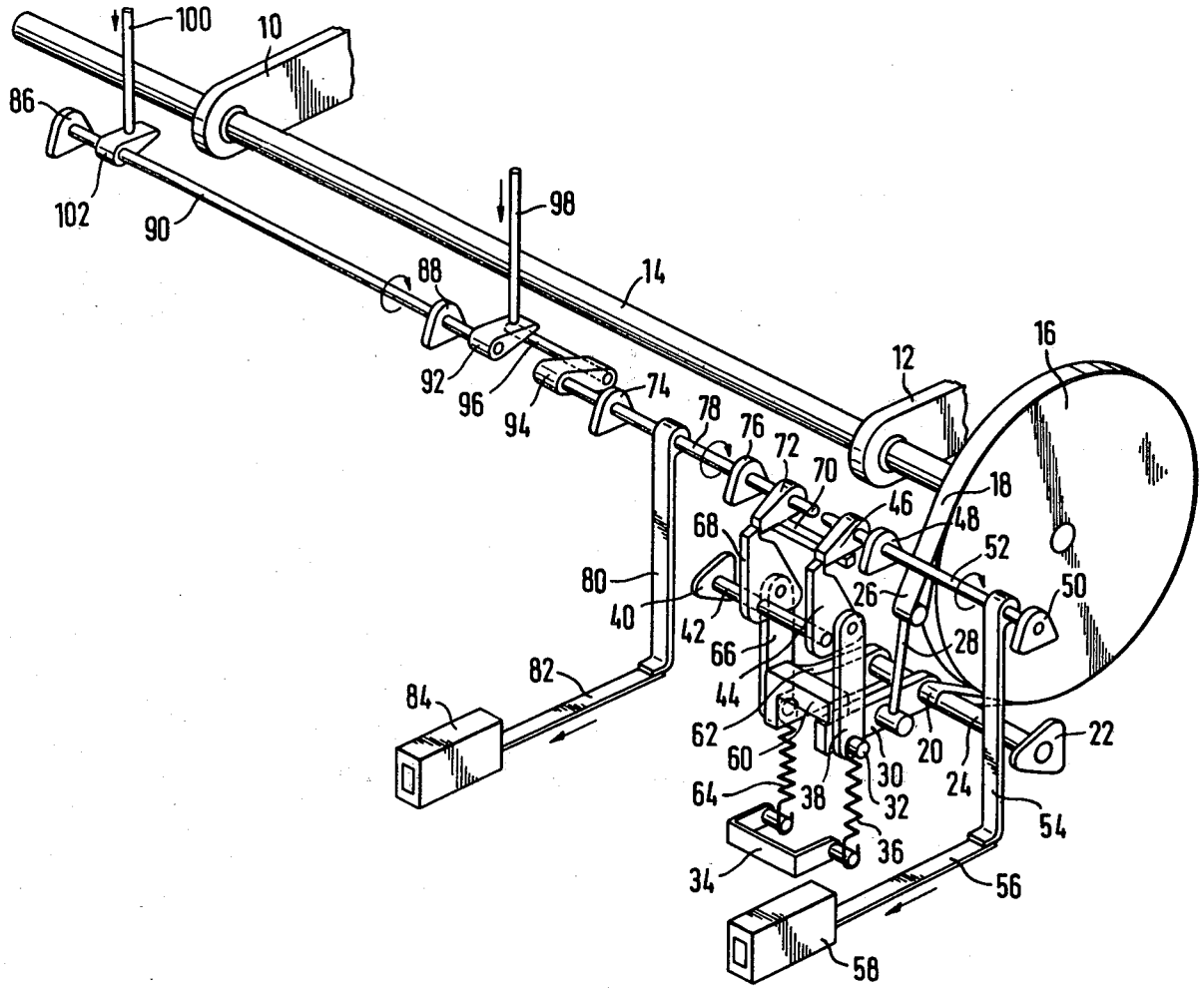
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102

BRAKE FOR A WEAVING MACHINE

This is a continuation of application Ser. No. 045,939 filed June 6, 1979 now abandoned.

This invention relates to a brake for a weaving machine.

As is known, when a weaving machine is in operation, a variety of disturbances may occur which require a very rapid interruption of the operation of the machine or a very rapid retardation in order to insure that any damage to the machine or to the article being processed is avoided or, at least, limited and to enable the fault to be cleared.

There are two main catagories of faults—those on the weaving side and those on the mechanical side. Those faults on the weaving side particularly include all breakages of warp and weft yarns. The most common faults on the mechanical side, are, e.g., in the case of gripper projectile machines, disturbances in projectile operation, faults in the projectile mechanisms on the picking and catching sides and faults of various drive elements, such as the cam follower levers generally employed in the weaving machines.

As is known, warp yarn detectors are generally constructed as electrical devices which operate to stop a weaving machine in the event of a warp yarn breakage. In similar fashion, weft yarn detectors may also be in the form of electrical devices which operate to stop the weaving machine in the absence of a weft yarn or in the event of a weft yarn breakage. Further, as is known, monitoring of the picking of a weft yarn must continue, for instance, in the case of a gripper projectile weaving machine, until the projectile has come to a complete stop in a catcher. This is because the main shaft angle at which the weft yarn breakage or any other picking fault has occurred is very important. For instance, if a gripper projectile machine is not stopped until a particular main shaft angle has been reached, the weft yarn cannot be readily re-inserted rapidly and properly on the picking side into a yarn recovery and feed mechanism which is customarily used in such machines. Either additional provision is required on the picking side so that the weft yarn can be inserted or an idle pick must be made with a subsequent correction of the shedding, the picking sequence and the cloth take-off. All these features are, however, undesirable since they waste time and are inconvenient for the machine operators to carry out.

The mechanical movements of gripper projectile weaving machines are usually protected on the picking side. For instance, protection is usually provided for the shuttle lift, shuttle opener, return opener and shears and, in the case of multiple-weft machines, for a weft changing device. Protection is also usually provided on the catching side, for instance, for the catching detector, catching brake, catching stick and the ejector. During operation, it is known that variations in yarn take-off forces and misadjustments of the usual torsion bar and brake may upset the arrival of the projectile in the catching mechanism. For example, the projectile may reach the catching mechanism either too late or not at all or the projectile may not penetrate far enough into the catching mechanism or may rebound therefrom or be pushed out too far when being pushed back. All of these disturbances are monitored by the catching detector. Further, the shed lifter and weft seeker usually have safeguards to prevent the machine from starting unless the corresponding units are in the proper operating position. The cam follower levers can be protected, for example, by the fulcrum of the lever being disposed in a detector slide which can move by overcoming the pressure of a spring. When the movement of the cam follower lever is jammed or blocked, e.g. because of an incorrect manipulation, the detector slide is forced away from the still rotating cam.

Usually, the above safety features act directly through corresponding linkages on one or more stop-motion shafts. That is, in the event of a trip, the particular stop-motion shaft concerned rotates to disengage a catch pin of the brake from a catch bar. The machine then stops immediately with a simultaneous stoppage of the motor, a release of a clutch connected with the motor and an application of the brake.

Of the faults noted above, those faults on the weaving side, i.e. faults indicated by warp deflectors and weft detectors are responsible by far for the largest proportion—more than 99% of the total—of machine stoppages. In the case of gripper projectile machines, the main reason for the other stoppages, i.e. stoppages due mainly to mechanical causes, is the catching detector. In most of the stoppages caused by detectors other than the catching detector, no immediate damage occurs to the weaving machine as a result of the stop angle of the main shaft increasing. However, this consideration would very rapidly lead to damage in the case of a stoppage caused by the catch detector. Delayed stopping of the machine would make damage unavoidable, particularly, with the fairly common fault of the projectile not penetrating far enough into the catching mechanism. In such cases, the projectile would be outside the range of the usual sley race parts which have to be moved to beat up the fabric.

Conventionally, most machines stoppages, whether caused by faults on the weaving side or on the mechanical side, are usually brought about within the same braking distance. In other words, the shortest braking distance which can be used at the highest machine speed concerned is used for most stoppages. Generally, this minimum braking distance is the factor determining the various machines stoppages, particularly, the stoppage by the catching detector, which is very important if the machine is not be damaged. However, the disadvantage of this feature is that braking becomes excessive for most of the stoppages and the braking distance is therefore unnecessarily short. This is because the most common stoppages are the ones caused by faults on the weaving side which do not result in damage to the machine. The heavy braking conventionally used is basically appropriate only for stoppages caused by faults on the mechanical side and, so far as faults on the weaving side are concerned, only for breakages or disturbances of the weft involving the main shaft rotating beyond a particular angle. Consequently, the weaving machine is, in most cases, braked too rapidly and too abruptly. This, in turn, leads to excessive wear of the brake and of the other elements of the machine.

As is known from Swiss Pat. No. 381,176, a brake has been used for a weaving machine which has a brake element which can be operated by braking forces of different magnitude. This brake has a two-part positioning rod which acts on a brake lever. The first part of the positioning rod is connected on one side to a pressure spring while the other side is connected over a clamping piece, a second pressure spring and a hook coupling to the second part. The second part is, in turn, connected to a shut-off shaft and to a pull-out lever. Upon actuation of the shut-off shaft, the coupling is opened so that both pressure springs act on the brake. Upon actuation by the pull-out lever, the coupling remains closed while the second spring remains inactive and only the first pressure-spring acts on the brake. Such a brake, however, has the drawback that the second pressure spring and the clamping piece have to be moved together with the positioning rod even when the second pressure spring should remain inactive. Thus, many mechanical parts and large masses are unnecessarily moved. As a result, a brake order from the pull-out shaft only is effected with retardation. Also, in the case of a brake order over the shut-off shaft, quite large masses have to be moved. In this regard, the first part of the positioning rod connected to the first pressure spring together with the coupling hook not only is very long but is firmly connected to the clamping piece. Thus, in this case, these elements have to be moved together with the positioning rod. The brake is, consequently, not only complicated but has a slow response with respect to brake orders due to the mass inertia.

Accordingly, it is an object of the invention to adapt the braking force and, thus, the braking distance of a brake of a weaving machine to the actual cause of fault.

It is another object of the invention to provide a brake of relatively simple construction for a weaving machine.

It is another object of the invention to provide a brake for a weaving machine which is capable of a fast response to braking orders.

It is another object of the invention to reduce the size of the masses which must be moved by a brake of a weaving machine.

Briefly, the invention provides a brake for a weaving machine which is comprised of a brake element, at least two means for selectively generating a braking force, a positioning member common to the two means for transmitting a braking force from at least one of the two means to the brake element and an abutment. The positioning member is articulated with one of the means for generating a braking force in order to receive and transmit a braking force therefrom to the brake element while also being separated from the other means for generating a braking force. The abutment is articulated with this other means in order to abut the positioning member and transmit a generated braking force from the second means to the positioning member in response to the second means generating a braking force.

By separating the positioning member from the second means for generating a braking force not only is the construction of the brake made simpler but also the size of the moved masses is substantially reduced. In one embodiment, the positioning member is in the form of a lever. In this case, the use of an otherwise heavy and complicated positioning rod may be eliminated. In particular, the braking lever usually used in a brake may be used as the positioning member. The resulting decrease of moved masses provides for a substantial decrease of the braking time and, thus, an improved response to braking orders.

These and other objects and advantages of the invention will become more apparent from the following detailed description and appended claims taken in conjunction with the accompanying drawing which illustrates a perspective view of a brake of a weaving machine constructed in accordance with the invention.

Referring to the FIGURE, the brake for a weaving machine (not shown) is constructed so as to operate on a main shaft 14 of the weaving machine. As shown, the main shaft 14 is rotatably mounted in fixed brackets 12, 10 of the weaving machine in known fashion.

The brake includes a brake element in the form of a brake drum which is mounted on the main shaft 14 so as to rotate therewith. In addition, a brake band 18 is disposed about the drum for braking the drum 16. As shown, the band 18 has a loop at one end which is engaged on a shaft 24 mounted in a fixed bracket 22 on the machine frame (not shown). The opposite end of the band 18 has a loop 26 which envelops one end of a rod 28. A positioning member in the form of a lever 30 is pivotally mounted on the shaft 24 and is fixed to the rod 28 so that the rod 28 is pivotable with the lever 30. At one end, the lever 30 carries a pin 32 to which a means for selectively generating a braking force is secured. As indicated, this means is in the form of a tension spring 36 which is anchored to a spring bracket 34 fixed within the machine frame (not shown).

A releasable means is also provided within the brake for holding the spring 36 in a tensioned state when the brake band 18 is in a relaxed state. This releasable means includes a link 38 which is articulated on the pin 32 and a pawl and ratchet means articulated to the opposite end of the link 38. As shown, this pawl and ratchet means includes an eccentric ratchet 44 which is pivotally mounted on a shaft 42 which, in turn, is mounted in a suitable bracket 40 fixed to the machine frame (not shown) as well as a pawl 46 which serves to hold the ratchet 44 in the illustrated position.

A release means is also provided for actuating the pawl and ratchet means 44, 46 in order to release the spring 36 from the tensioned state and to cause the spring 36 to generate a braking force through the lever 30 to the brake band 18. This release means includes a rotatable stop-motion shaft 52 which is mounted in brackets 48, 50 fixed to the machine frame (not shown) and on which the pawl 46 is fixedly mounted for rotation therewith. In addition, the release means includes a lever 54 which is secured at one end to the shaft 52, a spring strip 56 which is secured to an opposite end of the lever 54 from the shaft 52, and an electromagnet 58. The electromagnet 58 is connected to the strip 56 in order to pull the strip in response to a given signal which is received by the electromagnet 58. Pulling of the strip 56 is such as to cause rotation of the shaft 52 via the lever 54 and thus a release of the pawl 46 from the ratchet 44. This in turn allows the spring 32 to pivot the lever 30 in a counter-clockwise manner as viewed.

The part of the brake which is described above may operate independently and, for the sake of simplicity, is hereinafter referred to as the slow brake feature.

The brake also includes a second means for generating a braking force which is in the form of a spring 64. This spring 64 is connected at one end to a lever 62 which is pivotally mounted on the shaft 24 and at the opposite end is anchored on the bracket 34. Further, an abutment 60 is connected to the spring 64 for abutting the lever 30.

As above, a releasable means is provided for holding the spring 64 in a tensioned state and a release means is provided for actuating the releasable means in order to release the spring 64 to cause the spring 64 to generate a braking force through the abutment 60 to the lever 30 and, thus, to the brake band 18. As illustrated, the second releasable means includes a pawl and ratchet means having an eccentric ratchet 68 mounted on the shaft 42 and a pawl 72 disposed, as viewed, in blocking relation to the ratchet 68. In addition, the releasable means includes a link 66 which is connected between the ratchet 68 and the lever 62.

The release means for the pawl 72 and ratchet 68 is constituted by a stop-motion shaft 78 which is rotatably mounted within brackets 74, 76 fixed to the machine frame (not shown) and on which the pawl 72 is fixedly mounted for rotation therewith. In addition, this release means has a a second abutment 70 secured to the pawl 72 for abuting the pawl 46 upon rotation of the pawl 72. Further, the release means includes a means for rotating the stop-motion shaft 78 in response to a signal.

The means for rotating the stop-motion shaft 78 includes a lever 80 secured at one end to the shaft 78, a spring strip 82 secured to the opposite end of the lever 80 and an electromagnet 84 connected to the strip 82 for pulling the strip 82 in response to a signal. Pulling is such that the strip 82 causes rotation of the stop-motion shaft 78 and release of both pawl and ratchet means 72, 68; 46, 44.

In addition, in order to further rotate the shaft 78, a third stop-motion shaft 90 is rotatably mounted in brackets 86, 88 secured to the machine frame (not shown) and is selectively connected to the stop-motion shaft 78 via a linkage so that rotation of the shaft 90 causes rotation of the shaft 78. As shown, the linkage is embodied by a pair of levers 92, 94 which are respectively connected to the ends of the shafts 90, 78 and a rod 96 which is inserted in the lever 94 and which projects into the plane of rotation of the lever 92. The lever 94 and rod 96 is therefore able to move clockwise independently of the lever 92. In addition, a stop-motion rod 98 is connected to the lever 92 so as to effect rotation of the shaft 90 by a downward movement of the rod 98 as indicated. An additional stop-motion rod 100 can operate over a lever 102 fixed to an opposite end of the shaft 90 so that the shaft 90 can be rotated upon a downward movement of the rod 100.

The above described part of the brake is hereinafter referred to for the sake of simplicity as the fast or normal brake feature.

In operation, since the slow brake feature is required to operate substantially only for faults on the weaving side, it is assumed that the magnet 58 is connected by way of suitable signal lines (not shown) to an electronic warp detector or to an electronic weft detector. It is assumed in this context that, as far as a predetermined angular position of the main shaft of the machine, only signals of the electronic weft detector can be applied to the magnet 58. When such a signal acts on the magnet 58, the spring strip 56 moves in the direction indicated by the arrow to rotate the lever 54 and shaft 52 in the direction indicated. This, in turn causes the pawl 46 to rotate upwardly, as viewed, so that the ratchet 44 can be rotated clockwise, as viewed, under the force of the spring 36 and link 38. Simultaneously, the lever 30 pivots counter-clockwise, as viewed, and the pivoted rod 28 applies the brake band 18 to the brake drum 16. The spring 36 can be relatively weak so as to provide a gentle or slow braking action over a relatively long braking distance.

Insofar as the operation of the fast or normal brake feature is concerned, it is assumed that the magnet 84 is also connected to the electronic weft detector but receives fault signals only with effect from a particular angular position of the shaft 14. In the event that the magnet 84 receives a corresponding signal from the weft detector, the spring strip 84 is pulled in the direction indicated by the arrow so that the lever 80 rotates the shaft 78 in a clockwise manner as viewed. The pawl 72 is then caused to rotate clockwise, as viewed. In this case, not only is the ratchet 68 released, but also, the pawl 46 is rotated clockwise via the abutment 70. Consequently, the two ratchets 68, 44 rotate clockwise with the result that the two levers 30, 62 are pivoted in counter-clockwise manner under the force of the tension springs 36, 64. The abutment 60 thus transmits the tension of spring 64 to the lever 30 so that both springs 36, 64 act via the lever 30 and rod 28 on the brake band 18. The tension of the spring 64 can be much greater than the tension of the spring 36. As a result, a rapid or normal stop can be effected.

The rods 98, 100 can be connected to mechanical trip elements, such as the catch detector or a detector slide of a cam follower lever. If, for instance one of the shafts 98, 100 acts on the associated lever 92, 102 in the downward direction as indicated, the shaft 90 is caused to rotate in a clockwise manner as indicated. This, in turn, causes rotation of the shaft 78 via the linkage 92, 94, 96, and effects a rapid or normal stop as described above. Because of the flexibility of the spring strip 82, the strip 82 permits a passive pivoting of the lever 80 in this case.

Instead of using tension springs 34, 36 as the means to generate a braking force, use can be made of pull magnets or pneumatic cylinders. Further, the positioning member 30 may be formed as an axially guided body which can be triggered by the abutment 60 to act upon the brake band 18 and drum 16.

What is claimed is:

1. A brake for a weaving machine comprising a rotatable brake drum;

a brake band about said drum for braking said drum;

at least two springs for selectively generating a braking force;

a positioning member for transmitting a braking force from at least one of said springs to said brake band to brake said drum, said positioning member being connected to one of said springs and separated from the other of said springs;

a first pawl and ratchet means for releaseably holding said one spring in a tensioned state;

a first release means for actuating said pawl and ratchet means to release said one spring from said tensioned state and to cause said one spring to generate a braking force through said positioning member to said brake band, said first release means including a rotatable shaft having a pawl of said first pawl and ratchet means thereon, a lever secured to one end of said shaft, a spring strip secured to an opposite end of said lever from said shaft, and an electromagnet connected to said strip for pulling of said strip in response to a given signal whereby pulling of said strip causes rotation of said shaft and release of said first pawl and ratchet means;

an abutment connected to said other spring for abutting said positioning member;

a second pawl and ratchet means for releaseably holding said other spring in a tensioned state; and a second release means for actuating said second pawl and ratchet means to release said other spring to generate a braking force through said abutment to said positioning member and to said brake band, said second release means including a rotatable stop-motion shaft having a second pawl of said second pawl and ratchet means thereon, a second abutment secured to said second pawl for abutting said first pawl, and means for rotating said stop-motion shaft in response to a second signal, and latter means including a second lever secured at one end to said stop-motion shaft, a second spring strip secured to an opposite end of said second lever, and a second electromagnet connected to said second strip for pulling said second strip in response to said second signal whereby pulling of said second strip causes rotation of said stop-motion shaft and release of each pawl and ratchet means.

2. A brake as set forth in claim 1 wherein said positioning member is a pivotally mounted lever.

* * * * *